United States Patent [19]

Deverell

[11] Patent Number: 4,601,688

[45] Date of Patent: Jul. 22, 1986

[54] APPARATUS FOR PRODUCING ENVELOPE BLANKS

[75] Inventor: Roy A. Deverell, Bromley, England

[73] Assignee: Chapman Envelopes Limited, Kent, England

[21] Appl. No.: 543,509

[22] Filed: Oct. 19, 1983

[30] Foreign Application Priority Data

Apr. 6, 1983 [GB] United Kingdom ..... 8309298

[51] Int. Cl.[4] ..... B31B 27/14; B26D 3/14

[52] U.S. Cl. ..... 493/238; 83/911

[58] Field of Search ..... 83/355, 356.1, 356.3, 83/357, 911, 917; 493/227, 237, 238, 239

[56] References Cited

U.S. PATENT DOCUMENTS

| | | | |
|---|---|---|---|
| 2,182,002 | 12/1939 | Potdevin | 493/238 X |
| 2,254,907 | 9/1941 | Potdevin et al. | 493/237 X |
| 3,782,233 | 1/1974 | Helm | 83/911 X |
| 4,125,044 | 11/1978 | Carrigan et al. | 83/911 X |
| 4,130,039 | 12/1978 | Heyden et al. | 83/911 X |
| 4,429,603 | 2/1984 | Chapman et al. | 83/911 X |

FOREIGN PATENT DOCUMENTS

| | | | |
|---|---|---|---|
| 2537015 | 3/1977 | Fed. Rep. of Germany | 83/911 |

*Primary Examiner*—E. Michael Combs

*Attorney, Agent, or Firm*—McAulay, Fields, Fisher, Goldstein & Nissen

[57] ABSTRACT

An apparatus for producing envelope blanks has means for advancing a continuous web of paper along a horizontal path, two sets of rotatable cutter blades are located one on each side of the path of travel of the web. The blades are operable to cut out portions from each side of the web. The blades on each side of the said path being located on a common shaft. Each set of cutter blades comprises at least three cutter blades. Each blade is located on a cutter bracket mounted on the shaft so that the angular position of the blade on the shaft is adjustable through 360°. Each blade in each set is located opposite a similar blade in the other set to form a matching pair and the cutting profiles of the blades in each set are different and including a cutting point in each blade. The positions of the common shafts are also adjustable so that the sets of cutter blades are movable towards each other or away from each other as desired.

6 Claims, 5 Drawing Figures

APPARATUS FOR PRODUCING ENVELOPE BLANKS

BACKGROUND OF THE INVENTION

This invention relates to the production of envelope blanks by the method generally known as "fly cutting".

In a known method of fly cutting, a continuous web of paper is advanced in a generally horizontal path between two pairs of rotary cutters or knives. The cutters of each pair are located on opposite sides of the web at different positions along the line of travel of the web. The knives rotate to pass from top to bottom through the web as it advances to produce the cut out portions extending inwards from each of the side edges of the web.

An object of the present invention is to provide an improved way of producing envelope blanks by fly cutting.

BRIEF SUMMARY OF THE INVENTION

The invention provides an apparatus for producing envelope blanks comprising means for advancing a continuous web of paper along a horizontal path and two sets of rotatable cutter blades located one on each side of the path of travel of the web and operable to cut out portions from each side of the web, the blades on one side of the said path being located on a common shaft, and the blades on the other side of the said path being located on a common shaft, wherein each set of cutter blades comprises at least three cutter blades, each blade being located on a cutter bracket mounted on its common shaft so that the angular position of the blade on that shaft is adjustable through 360°, each blade in each set being located opposite a similar blade in the other set to form a matching pair and the cutting profiles of the blades in each set being different and including a cutting point in each blade, and wherein the position of each of the common shafts is also adjustable so that the sets of cutter blades are movable towards each other or away from each other as desired. With this arrangement the positions of the cutting points on the blades are individually adjustable.

Trimming cutter means are provided in such a position that they are passed by blanks cut from the web by the opposed set of cutter blades, such trimming cutter means being operable to trim surplus portions of paper from the blanks. Means are also provided to sever the web transversely at regular portions along its length to produce the separate blanks from the continuous web.

BRIEF DESCRIPTION OF THE ACCOMPANYING DRAWINGS

Figure 2:
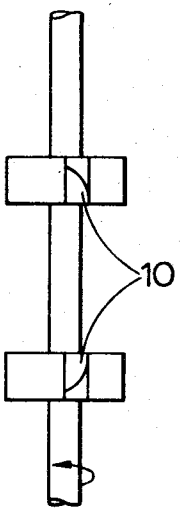
Figure 1:
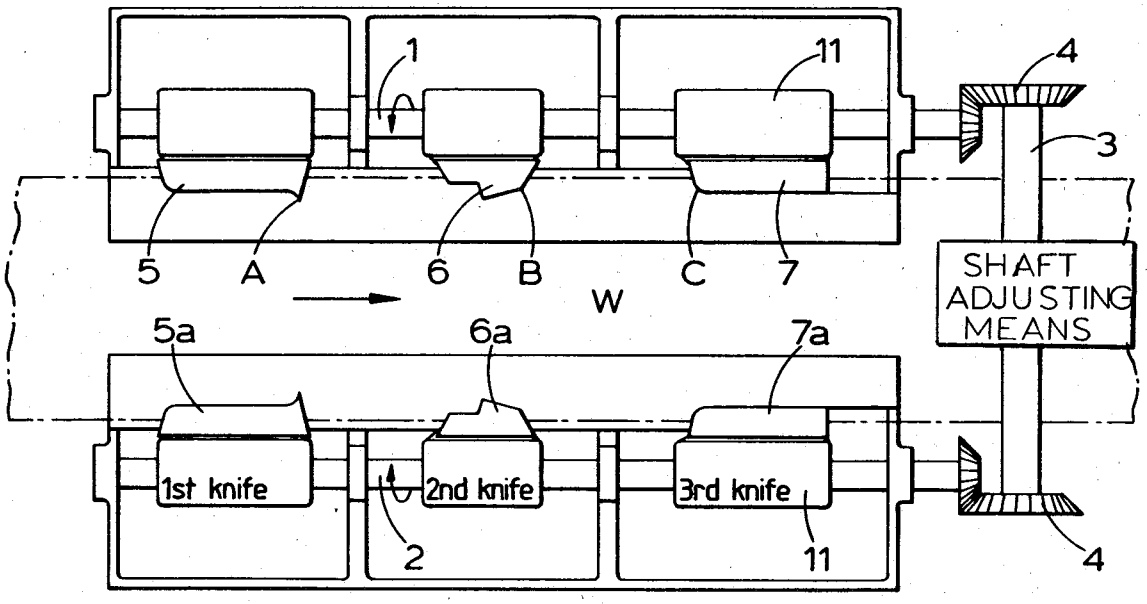
Figure 3:
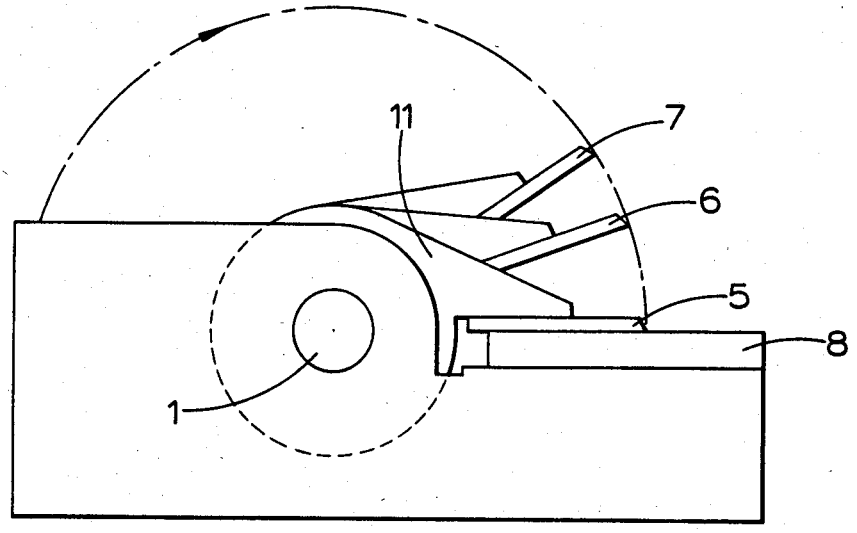
Figure 4:
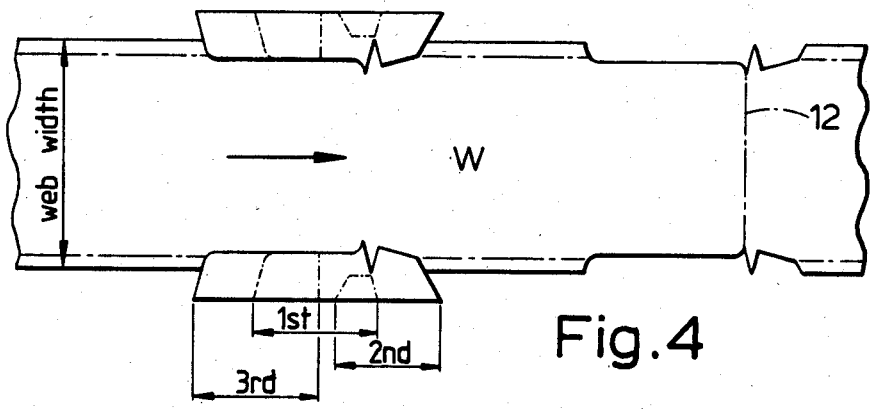
Figure 5:
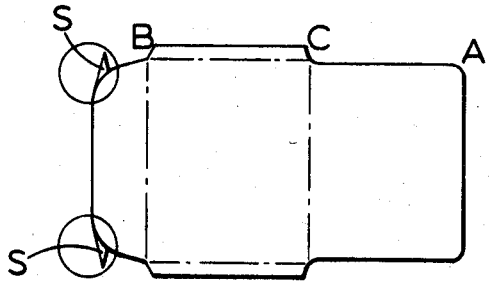

FIG. 1 is a diagrammatic plan view illustrating a fly cutting apparatus according to the invention, FIG. 2 illustrates a trimming device, FIG. 3 is a diagram illustrating the relative angular positions of knives of the apparatus, FIG. 4 is a diagram illustrating the cutting of the web to produce a blank and FIG. 5 is a view of the blank so produced.

In the embodiment of the invention illustrated in the drawings, a continuous web W of paper is caused to advance in a horizontal path indicated by the arrow between opposed sets of cutting devices located on opposite sides of the web W. Each of these cutter devices includes a horizontal common shaft 1,2 which are rotatable in opposite directions by a drive shaft 3 acting through gearing 4. Each of the set of cutting device includes at least three knives or cutter blades respectively numbered 5, 5*a*, 6, 6*a*, 7, 7*a*. The various knives or cutter blades are arranged to rotate through the web W from top to bottom and co-operate with static anvils 8 located beneath the web and having cutter openings each of a shape complimentary to that of the co-operating knife or cutter blade.

Each of the knives of each set forms a matched pair with the opposite knife in the other set and the two knives of each pair are timed to cut the paper at the same time. Thus, identical cut out portions are formed in each side edge of the web as clearly indicated in FIG. 4.

Each knife is carried on its common shaft by a bracket 11 so mounted on the shaft that the angular position of the knife is adjustable through 360°. Since the shafts are rotated at a constant speed and the web is also advanced at a constant speed, the time at which each knife passes through the paper, and thus the position of each cut out portion, is determined by the angular setting of each knife. Each bracket has a screw clamp by which bracket and knife can be fixed in a desired setting.

The cutting edges of the knives in each pair have different cutting profiles. In decribing these profiles hereinafter each knife will be assumed to be in its vertical position i.e., a position in which it is perpendicular to the plane containing the web. Also in describing these knife profiles the front edge of the knives will be the edge first passed by the paper in its advance through the set of knives. In the set of knives illustrated the first pair of knives 5 and 5*a* has converging front and rear edges with a generally horizontal top edge having a sharp cutting point or nose A. The second knife 6 or 6*a* has converging front and rear edges with a rearwardly sloping top edge B extending between these edges with a cutting point at the front of the edge. The third knife 7 or 7*a* has converging front and rear edges and a horizontal top edge with a rounded corner or cutting point C at the top of the front edge.

The front knife 5 or 5*a* is longer than the other two knives and therefore makes a longer cut. The timing of the knives is such that when the second knife 6 or 6*a* passes through the paper part of it enters the space already cut by the first knife but the rear part of it lengthens cut out portion to the rear as clearly shown in FIG. 4. Likewise, when the third knife 7 or 7*a* goes through the paper the rear part of the knife enters the cut out portion already produced by the first knife and the front portion of the knife lengthens cut out portion to the front. Due to the adjustability of the knives, the positions of the cutting points A, B and C are independently and individually adjustable. This permits the style and size of the blanks provided to be adjusted within the range of the machine and is an advantage over known machines.

Rotary trim cutters 10 (FIG. 2) are provided at a trim station to trim any surplus portions S from the blank left after the operation of the knives 5, 6 and 7. This trim station is an important feature of the machine of this invention.

The sets of knives are mounted in cutter boxes which are adjustable so that the spacing between the sets of knives can be adjusted.

A further advantage of the machine of this invention is that the rotatable knives are common to the complete range and style of blanks produced by the machine. This enables the knives to be dynamically balanced which is essential for high speed machinery.

The shafts 1 and 2 can be of sufficient length to enable additional cutters to be accommodated if so required.

Means are provided for severing the blank along lines 12 (FIG. 4) to divide the cut web into envelope blanks as illustrated in FIG. 5.

What is claimed is:

1. In an apparatus for producing envelope blanks comprising means for advancing a continuous web of paper along a horizontal path and two sets of rotatable cutter blades located one on each side of the path of travel of the web and operable to cut out portions from each side of the web, the blades on one side of the said path being located on a common shaft and the blades on the other side of the said path being located on a common shaft, the improvement wherein each set of cutter blades comprises at least three longitudinally spaced movable cutter blades, each of said movable cutter blades being positioned in longitudinal alignment with a different respective stationary blade, each movable blade being located on a cutter bracket mounted on its common shaft so that the angular position of the blade on that shaft is adjustable through 360° , each movable blade in each set being located opposite a similar movable blade in the other set to form a matching pair and the cutting profiles of said movable blades in each set being different and including a cutting point in each movable blade.

2. Apparatus as claimed in claim 1 wherein trimming cutter means are provided in such a position that they are passed by blanks cut from the web by the opposed set of movable cutter blades, such trimming cutter means being operable to trim surplus portions of paper from the blanks.

3. An apparatus according to claim 2 comprising means operable to sever the web transversely at regular portions along its length thereby to produce separate blanks from the continuous web.

4. An apparatus as claimed in claim 1, wherein each movable blade is carried on its common shaft by a bracket so mounted on the shaft that the angular position of said movable blade is adjustable through 360°, each bracket having a screw clamp by which the bracket can be fixed in a desired setting.

5. An apparatus as claimed in claim 4 wherein the bracket is so mounted on the shaft that each movable cutter blade is adjustable longitudinally of the shaft.

6. An apparatus as in claim 1, and means for adjusting the position of the common shafts so that the sets of movable cutter blades are movable towards each other or away from each other as desired.

* * * * *